US005485734A

United States Patent [19]

Yang

[11] Patent Number: 5,485,734

[45] Date of Patent: Jan. 23, 1996

[54] COMBINATION LOCK

[76] Inventor: Kuo-Tsung Yang, No. 1, Alley 8, Lane 137, Fu Teh St., Taipei, Taiwan

[21] Appl. No.: 164,003

[22] Filed: Dec. 8, 1993

[51] Int. Cl.[6] ..... E05B 37/00; E05B 65/48

[52] U.S. Cl. ..... 70/285; 70/312; 70/71; 70/74

[58] Field of Search ..... 70/64, 67, 69–76, 70/284, 285, 312, 315–318

[56] References Cited

U.S. PATENT DOCUMENTS

| | | | |
|---|---|---|---|
| 3,408,839 | 11/1968 | Walters | 70/285 |
| 4,499,745 | 2/1985 | Ricouard et al. | 70/285 |
| 4,557,122 | 12/1985 | Hwang | 70/284 |
| 4,671,088 | 6/1987 | Jeang | 70/284 X |
| 4,719,777 | 1/1988 | Hwang | 70/312 |
| 4,852,372 | 8/1989 | Ling | 70/74 X |
| 4,885,923 | 12/1989 | Nakai | 70/284 |
| 4,926,663 | 5/1990 | Azzalin | 70/74 |
| 5,211,040 | 5/1993 | Gisiger | 70/71 |
| 5,237,842 | 8/1993 | Rasch et al. | 70/312 X |
| 5,372,022 | 12/1994 | Terada et al. | 70/71 |

*Primary Examiner*—Peter M. Cuomo
*Assistant Examiner*—Suzanne L. Dino
*Attorney, Agent, or Firm*—Webb Ziesenheim Bruening Logsdon Orkin & Hanson

[57] ABSTRACT

A combination lock integrates the key lock performance into a combination lock, so that it can be unlocked by a supplement key when the combination number has been forgotten. The combination lock includes a base and cover assembly equipped with at least one numerical wheel, a sliding block slidably received within the base and cover assembly, a control means which has an engaging element being operably received on the sliding block, and sliding plate slidably received between the base and the sliding block. The sliding plate has at least one ear to control a sliding movement of the sliding plate and cooperate with the at least one numerical wheel, and a guide portion cooperating with the engaging element. The guide portion has two ends, the sliding plate being confined to move with the sliding block when the engaging element is in the first end and the sliding block being freely slidable relative to the sliding plate when the engaging element is in the second end.

6 Claims, 5 Drawing Sheets

COMBINATION LOCK

BACKGROUND OF THE INVENTION

1. Field of the Invention

The present invention relates to a combination lock used on a purse or the like and, more particularly, to a novel and improved combination lock which is openable by a key only, integrating a key-lock function into a combination lock.

2. Description of Related Prior Art

Nowadays, combination locks are widely used on a purse or the like as a securing device for preventing the contents in the purse from being stolen by others. If, somehow, the user forgets the correct combination and he/she needs the contents in the purse in a hurry then he/she will be forced to destroy the lock to access the needed materials and thus ruin the purse. This situation commonly occurs in real life situations. Therefore, an improved design to overcome this drawback and enhance the performance and application of the combination lock is desired.

The present invention provides a novel and effective design to solve this long-existing problem and make the combination lock, more applicable,

SUMMARY OF THE INVENTION

The present invention provides a combination lock which is openable by a key only. The combination lock integrates a key-lock function into a combination lock in such a manner that the combination lock has two ways to be unlocked. In addition to the ordinary way, which uses the numerical wheels, to unlock the combination lock, the present invention provides an alternate way, which uses a key only, i.e., irrespective of the condition of the numerical wheels, to unlock the combination lock. In other words, the combination lock of the present invention can be unlocked independently either by the numerical wheel or by a key.

It is an object of the present invention to provide an integrated combination lock that has an alternate unlocking function used as a supplement option to unlock the combination in a situation that the correct numeral combination has been forgotten.

Other objects and novel features of the invention will become more apparent from the following detailed description when taken in conjunction with the accompanying drawings.

DETAILED DESCRIPTION OF PREFERRED EMBODIMENT

Figure 1:
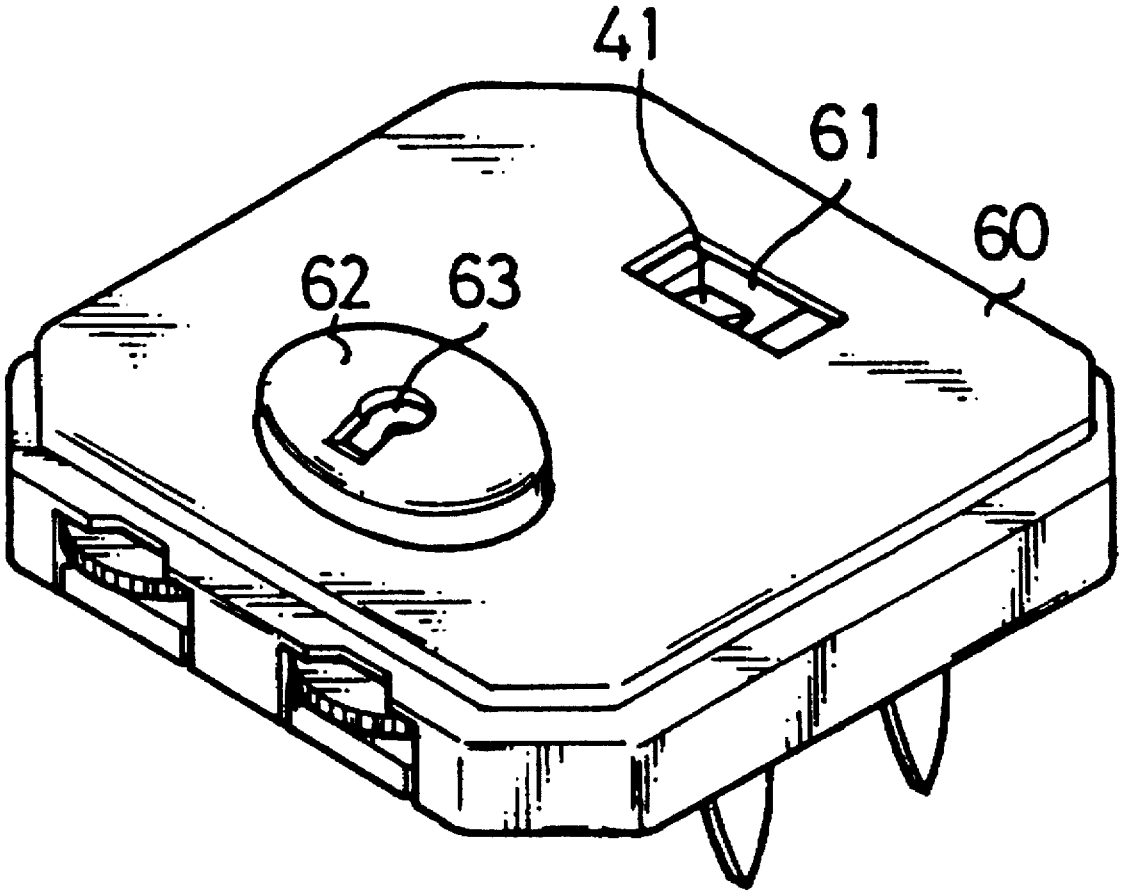
FIG. 1 is a perspective view of a combination lock of the present invention.
Figure 2:
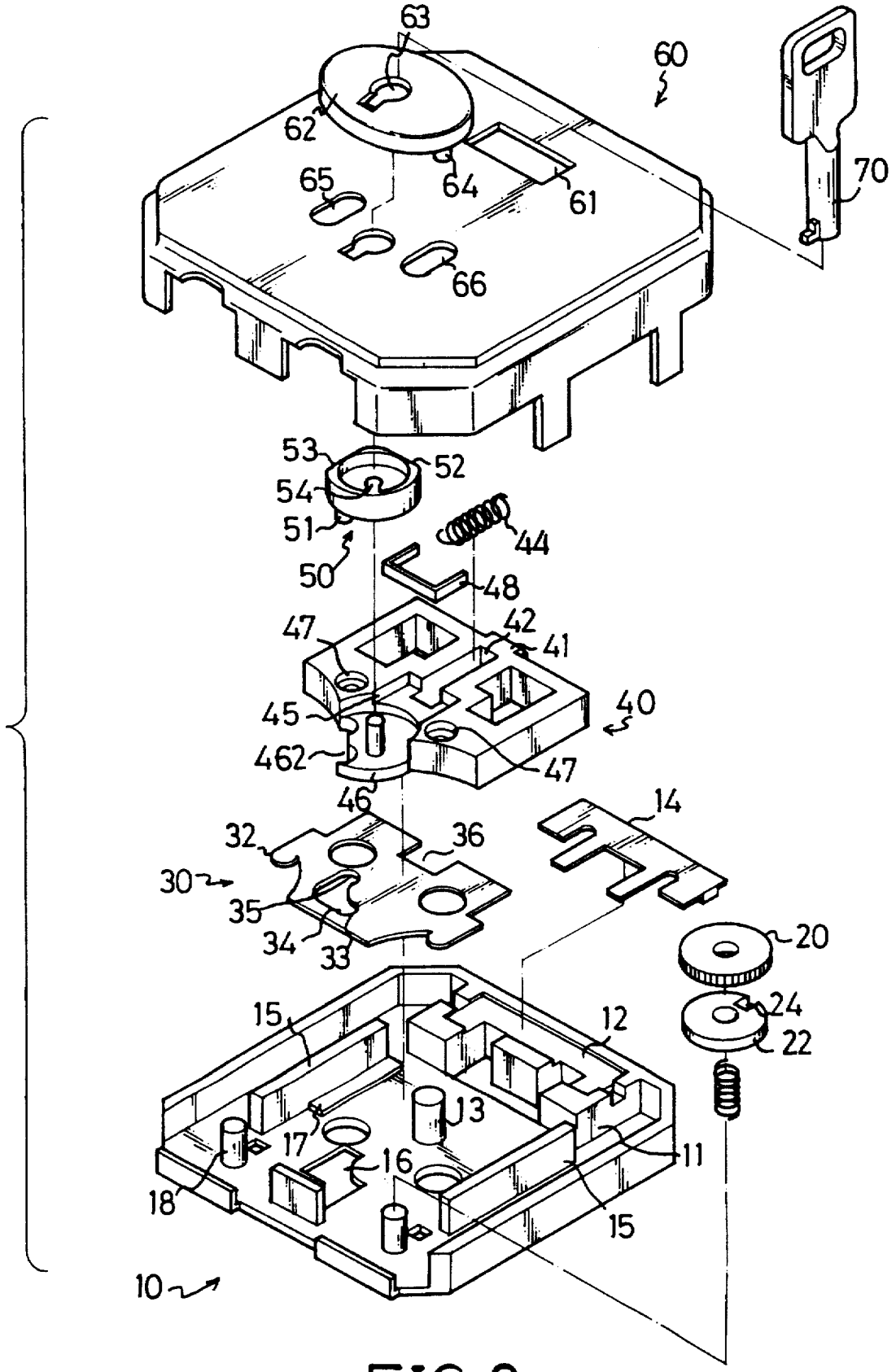
FIG. 2 is an exploded perspective view of the combination lock shown in FIG. 1.
Figure 3:
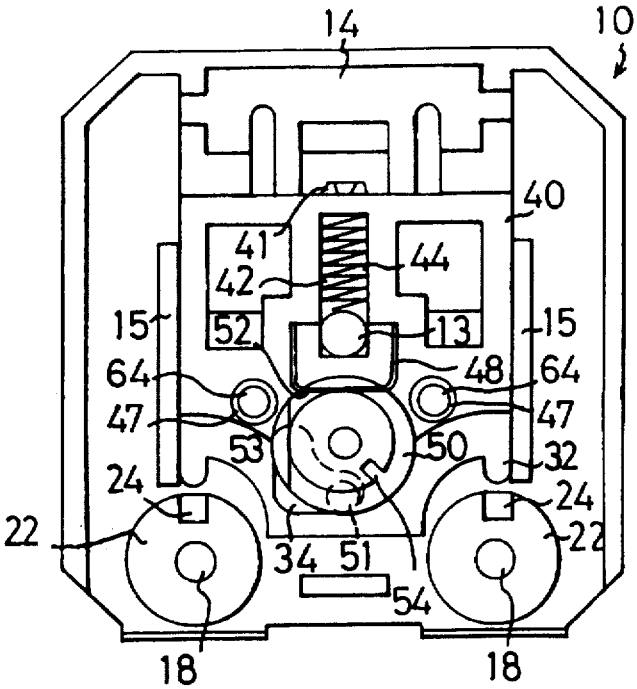
FIG. 3 is atop view illustrating, with the cover being taken off, the engaging peg being in the first end of the L-shaped slot to confine the sliding block to move with the sliding plate.

Referring now to the drawings, FIGS. 1 and 2 illustrate that the combined combination lock of the invention is largely composed of a base 10, a pair of numerical wheels 20 (only one is shown), a sliding plate 30, a sliding block 40, a cylindrical hollow shaped control means 50 and a cover 60.

The base 10 defines a pair of receiving pegs 18 at its front side for rotatably receiving the numerical wheels 20, a ┐-shaped groove 16 between the receiving pegs, a pair of elongated blocks 15 at its lateral sides, a substantially M-shaped block 11 at its rear side and a central peg 13 at the center. A pair of long, slim strips 17 are defined at the inner bottom sides of the elongated block 15 over a portion of its length to form a ladder sliding trail. The M-shaped block 11 has a recess 12 thereon for receiving a plate spring 14.

The sliding plate 30 is slidably placed on the base 10. The sliding plate 30 defines a pair of ears 32 at its lateral sides to cooperate with a notch 24 formed in the side of each numerical wheel 20 for controlling the sliding movement thereof. An L-shaped slot 34 is defined on the sliding plate 30 at a position aligning with the ┐-shaped groove 16. The L-shaped slot 34 has a first end 33 and a second end 35, the longitudinal axis of the first end 33 being perpendicular to the sliding direction of the sliding block 40 and the longitudinal axis of the second end 35 being parallel to the sliding direction of the sliding block 40. A notch 36 is defined at the rear side for the central peg 13 to extend through.

The sliding block 40 is slidably disposed over the sliding plate 30 and on the surface of slim strips 17. An elongated slot 42 is defined to receive the central peg 13. A bias spring 44 is affixed to the central peg 13 within the elongated slot 42 for biasing the sliding block 40. A locking tip 41 is defined at its rear side to slidably engage with an externally inserted fixing means (not shown) known to this art. A disk-shaped recess 46 is formed at the center of the front side for rotatably receiving the control means 50. The disk-shaped recess 46 has an M-shaped notch 462 defined at a position aligning with the L-shaped slot 34. A U-shaped recess 45 is formed right behind the disk-shaped recess 46 for receiving a securing element 48. A pair of actuated holes 47 are defined at the two sides of the disk shaped recess 46.

The cylindrical-shaped control means 50 has an engaging peg 51 extending through the M-shaped notch 462 into the L-shaped slot 34. A driven tip 54 inwardly extends to the hollow portion of the control means 50 to be driven by a key 70 for driving the engaging peg 51 from the first end to the second end of the L-shaped slot 34. The outer surface of the cylindrical wall is flat in two adjacent places 52, 53 at a right angle for cooperating with the securing element 48 to maintain the engaging peg 51 in one of the two ends 33, 35 of the L-shaped slot 34.

The cover 60 matchingly covers the base 10. The cover 60 has a hole 61 for insertion of a fixing means (not shown) to engage with the locking tip 41. A driving cap 62 having a key hole 63 therethrough is disposed over the cover 60 with two actuating pegs 64 extending through holes 65, 66 on the cover 60 into the actuated holes 47 on the sliding block 40.

Figure 4:
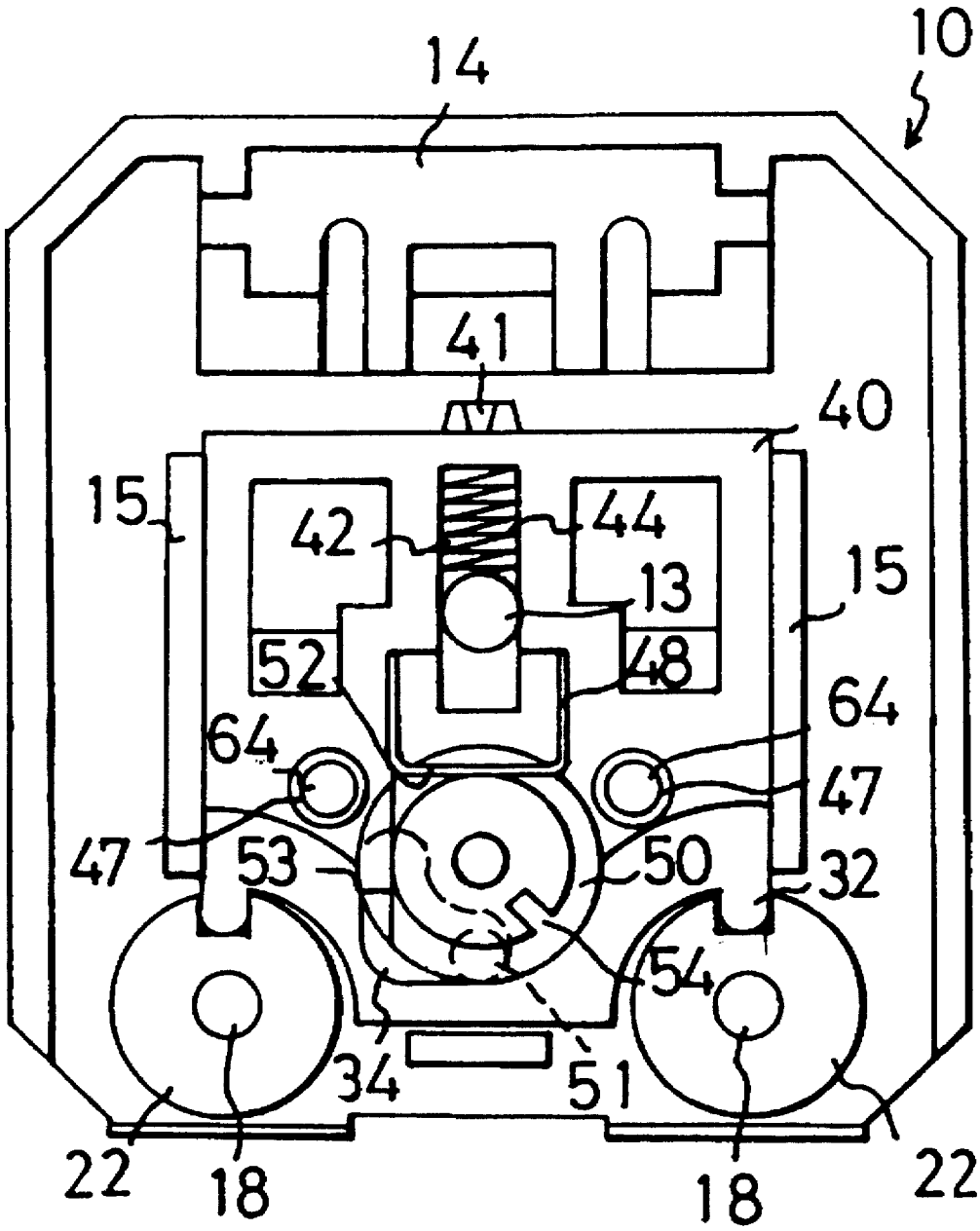
FIG. 4 is atop view illustrating, with the cover being taken off, the use of the numerical wheels to unlock the combination lock of the present invention.

Now, referring to FIGS. 3 through 6, FIG. 3 illustrates the engaging peg 51 being in the first end 33 of the L-shaped slot 34. Since the first end 33 is in a perpendicular orientation to the sliding direction of the sliding block 40, the sliding block 40 will move with the sliding plate 30. In this state, this combined combination lock functions as an ordinary combination lock. That is, the only way of unlocking the lock is to slide the two ears 32 of the sliding plate 30 into the notches 24 of the numerical wheels by means of manually moving the driving cap 62 and thus causing the actuating pegs 64 to cam the sliding block 40 into a retracted position and to bring the sliding block 40 away from locking position when the numerical wheels are turned to an unlocking position, as shown in FIG. 4.

Figure 5:
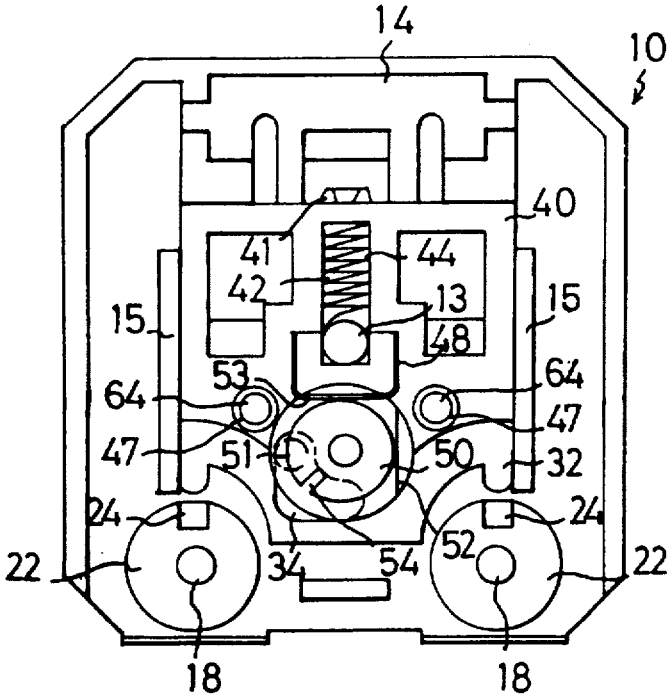
FIG. 5 is a top view of the combination lock shown in FIG. 3 with the engaging peg being in the second end of the L-shaped slot to release the sliding block from the sliding plate.
Figure 6:
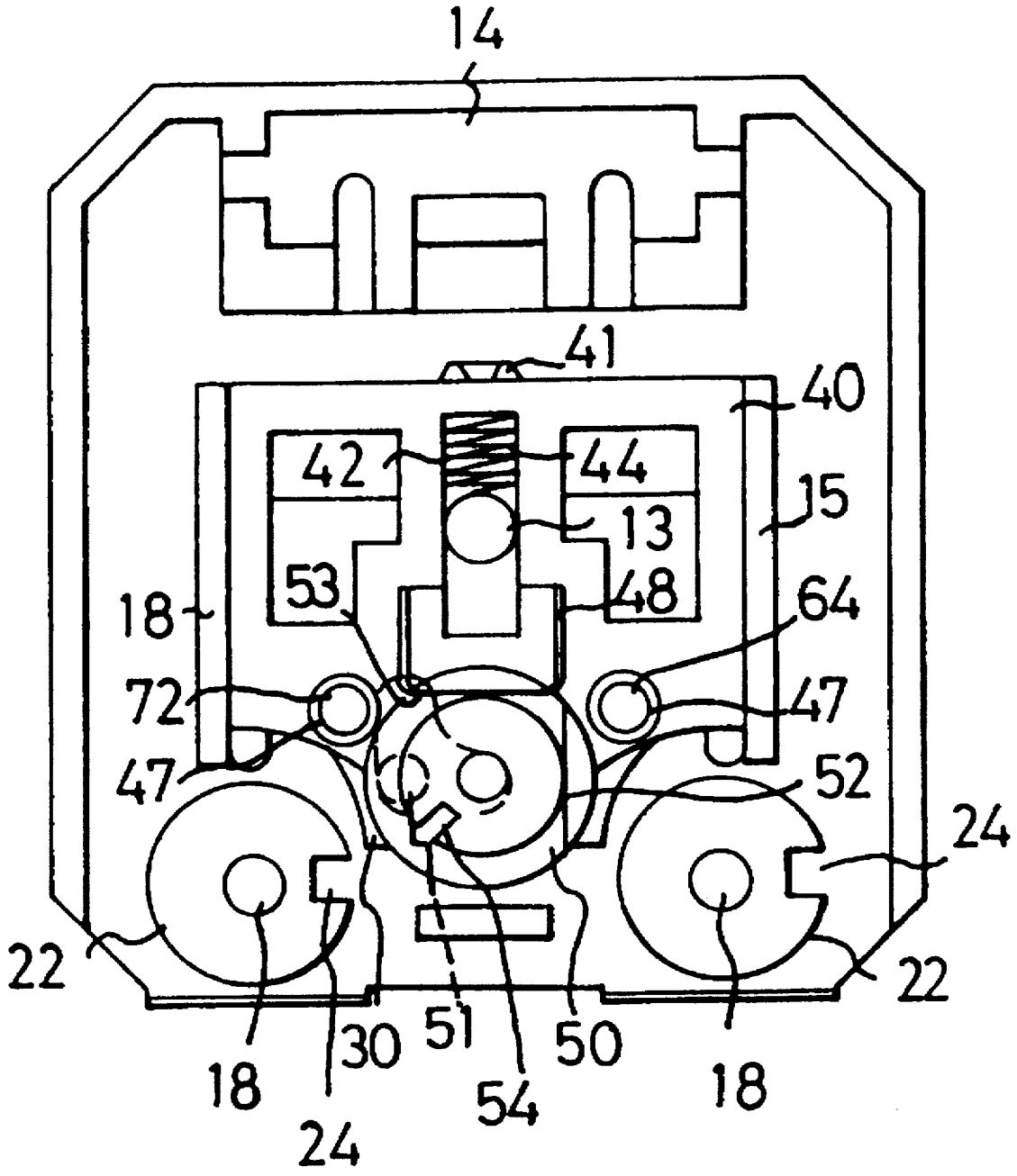
FIG. 6 is a top view illustrating an alternate unlocked state when the engaging peg is in the second end and the numerical wheels are in the locking position.

FIG. 5 illustrates the engaging peg 51 being turned by a key 70 (shown in FIG. 2) from the first end 33 to the second end 35 of the L-shaped slot 34. Because the second end 35 is in a parallel orientation to the sliding direction of the sliding block 40, the sliding block 40 is released from the sliding plate 30 and able to move freely relative to the sliding plate 30 when the sliding block 40 is cammed to move by the actuating pegs 64 of the driving cap 62. That is, the combined combination lock being unlocked by the key, even though the numerical wheels are in a locked position (as shown in FIG. 6)

Although the invention has been explained in relation to its preferred embodiment, it is to be understood that many other possible modifications and variations can be made without departing from the spirit and scope of the invention as hereinafter claimed.

I claim:

1. A combination lock comprising:

a base equipped with at least one numerical wheel;

a cover engageable with the base;

a driving element operably mounted on the cover;

a sliding block slidably received within the base and cover and actuated by the driving element;

a control means being operably received on the sliding block and operable by a key to rotate a downwardly extending engaging element thereof to switch the combination lock between a key-openable mode and an a numerical-wheel-openable mode; and a sliding plate slidably received between the base and the sliding block, the sliding plate having:

at least one ear to cooperate with the at least one numerical wheel and thereby selectively enabling a sliding movement of the sliding plate, and a guide portion adapted to cooperate with the engaging element and arranged such that the sliding block is confined to move with the sliding plate when the engaging element is in a first end of the guide portion and the sliding block is freely slidable relative to the sliding plate when the engaging element is in a second end of the guide portion.

2. A combination lock as defined in claim 1, further comprising a groove on the base, the groove being aligned with the engaging element and having a sufficient space for the engaging element to move freely between the two ends of the guide portion.

3. A combination lock as defined in claim 1, wherein the sliding block comprises a securing means for selectively maintaining the engaging element in the two ends of the guide portion.

4. A combination lock as defined in claim 1, wherein the guide portion is an L-shaped slot with a first end and a second end, the longitudinal axis of the first end being perpendicular to a direction of the sliding block and the longitudinal axis of the second end being parallel to the direction of the sliding block.

5. A combination lock as defined in claim 1, wherein the sliding block comprises a receiving portion for receiving the control means, the receiving portion having a portion for the engaging element to extend through and be operable therein.

6. A combination lock as defined in claim 1, wherein the control means is manipulatable externally by a key.

* * * * *

UNITED STATES PATENT AND TRADEMARK OFFICE

CERTIFICATE OF CORRECTION

PATENT NO. : 5,485,734

DATED : January 23, 1996

INVENTOR(S) : Kuo-Tsung Yang

It is certified that error appears in the above-indentified patent and that said Letters Patent is hereby corrected as shown below:

Column 1 Line 39 "wheel" should read --wheels--.

Column 1 Line 56 "atop" should read --a top--.

Column 1 Line 61 "atop" should read --a top--.

Claim 1 Line 1 Column 4 "and an a" should read --and a--.

Signed and Sealed this

Ninth Day of April, 1996

Bruce Lehman

*Attest:*

BRUCE LEHMAN

*Attesting Officer*

*Commissioner of Patents and Trademarks*